US005611111A

United States Patent [19]

Bosgoed

[11] Patent Number: 5,611,111

[45] Date of Patent: Mar. 18, 1997

[54] CURTAIN RAIL GLIDER

[75] Inventor: Henrikus W. F. Bosgoed, Schalkhaar, Netherlands

[73] Assignee: Forest Group Nederland B.V., El Deventer, Netherlands

[21] Appl. No.: 565,273

[22] Filed: Nov. 30, 1995

Related U.S. Application Data

[63] Continuation of Ser. No. 216,012, Mar. 21, 1994, abandoned.

[30] Foreign Application Priority Data

Mar. 24, 1993 [NL] Netherlands ..... 9300531

[51] Int. Cl.[6] ..... A47H 13/12

[52] U.S. Cl. ..... 16/93 D; 16/94 D

[58] Field of Search ..... 16/87.4, 93 D, 16/94 D, 95 D, 96 D

[56] References Cited

U.S. PATENT DOCUMENTS

| | | | |
|---|---|---|---|
| 2,848,735 | 8/1958 | Ault et al. . | |
| 3,609,795 | 10/1971 | Znamirowski et al. | 16/87.4 R |

FOREIGN PATENT DOCUMENTS

| | | | |
|---|---|---|---|
| 1321572 | 2/1962 | France . | |
| 1476717 | 2/1966 | France . | |
| 1077841 | 3/1960 | Germany . | |
| 1179342 | 10/1964 | Germany . | |
| 2440665 | 3/1976 | Germany . | |
| 8527230.2 | 9/1986 | Germany . | |
| 368586 | 5/1963 | Switzerland . | |
| 387892 | 5/1965 | Switzerland . | |
| 454378 | 6/1968 | Switzerland . | |
| 539414 | 9/1973 | Switzerland . | |
| 657511 | 4/1984 | Switzerland | 16/87.4 |
| 661424 | 7/1987 | Switzerland . | |
| 2028637 | 3/1980 | United Kingdom | 16/95 D |
| 2218621 | 11/1989 | United Kingdom . | |

OTHER PUBLICATIONS

"Hand Drawn Curtain Track Systems From Silent Gliss", 12pp.

*Primary Examiner*—M. Rachuba
*Assistant Examiner*—Kenneth J. Hansen
*Attorney, Agent, or Firm*—Larson and Taylor

[57] ABSTRACT

The invention comprises a glider with a head portion (1), a connecting portion (3) and a bottom portion (4), the connecting portion (3) having a smaller side than the bottom side of the head portion or the upper side of the bottom portion, the bottom portion being asymmetrical, and an eye(10), intended to bear a curtain hook towards one side, having been shifted to an outer surface (14) of the bottom portion.

8 Claims, 1 Drawing Sheet

CURTAIN RAIL GLIDER

This application is a continuation of application Ser. No. 08/216,012 filed Mar. 21, 1994, now abandoned.

The invention relates to a glider for hanging a curtain on a curtain rail, comprising head portion having a lower surface with a first width, below the head portion a connecting portion with a second width smaller than the first width, and underneath it a bottom portion with a third width greater than the second width, the connecting portion being widthwise located halfway between the head portion and the bottom portion, and the bottom portion being provided with an eye, in which a curtain hook attached to a curtain can be inserted.

Such gliders are known in various embodiments, such as gliders insertable with a click or not, gliders with spring lips that may or may not bounce against a supporting part, and gliders provided with rollers. The situation, however, now occurs that, when hanging a curtain, for instance by means of modern curtain hooks, it extends above the glider's eye. As a result the curtain may come in a bothersome manner into contact not only with the curtain rail, but in particular with the ceiling supports, which may secure the curtain rail to the ceiling. Such supports have, for example, a shape that enables them to clutch around projections at the left and the right side of the curtain rail's upper surface. When now it is desired to open or draw a curtain, the danger exists that the curtain will come into contact in particular with said ceiling supports, which is not only a nuisance and may lead to the exertion of too great forces when the curtain gets jammed, but, moreover, may cause wear and tear of the curtain.

The invention aims at resolving these difficulties without raising the cost price of the glider and, in addition, at ensuring that the curtain, also at its top edge, hangs in a more proper way.

The aforementioned aims are attained in accordance with the invention by providing that the eye, seen widthwise, is located on one side of the width of the bottom portion.

As a result it is achieved that the suspension point of the curtain hook is shifted toward the outside of the glider, causing clearance for the curtain part located above the curtain hook. Since in practice curtains do not hang entirely straight on their hooks, the invention provides in practice a completely satisfactory solution to said difficulties.

A first wall of the eye, i.e. its outside wall, is preferably located in a surface that is aligned with the adjoining end of the bottom portion's width.

Sufficient strength and an attractive appearance are obtained by providing a second wall of the eye in a curved surface that has been bent from a point parallel to the first wall to approximately the middle of the glider's width.

As a matter of fact, the glider may be of a type known per se. It is, for example, provided that the glider is made of rigid elastic synthetic material and that it accommodates a slit in the middle of the head portion. This has the effect that the head portion can be slightly resilient, which makes the glider insertable with a click, as has been described for instance in the Netherlands patent application 9202134 in the name of applicant.

Said slit has side walls inclining under a preferably small angle, for example 5°. Generally, in using for example polythene as a synthetic, sufficient elasticity is obtained when the slit has a trapezium-shaped profile, its short side being parallel to the bottom surface of the head portion, and preferably at the same height as said bottom surface or approximately so.

The invention also comprises a construction of a curtain rail which has in its bottom side a slot and, at the upper corners, a slightly protruding reinforcement rib, a ceiling support clutching around said ribs and a glider according to the invention as has been specified hereinabove, serving to bear the curtain hooks including a curtain attached thereto.

The invention will hereinafter be further explained, reference being made to the drawing, where:

DETAILED DESCRIPTION OF THE INVENTION

Figure 1:
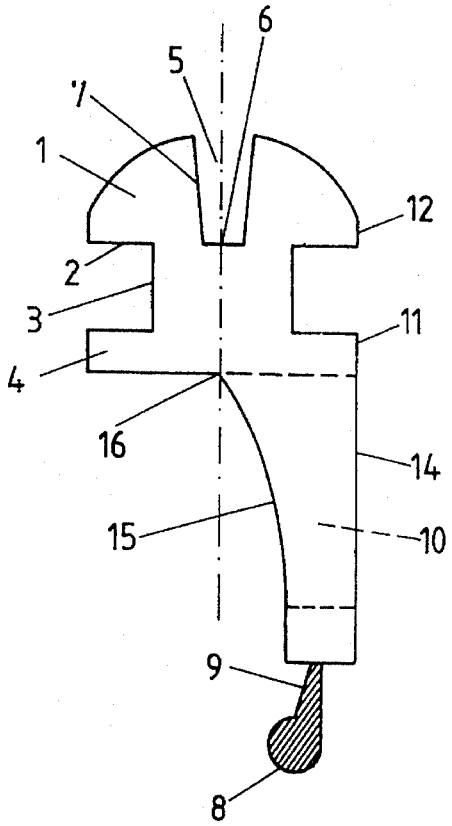
FIG. 1 shows a side-view of a glider according to the invention.

In FIG. 1 a glider made for example of rigid elastic synthetic material is shown comprising a head portion 1 which has a bottom surface 2 of a first width. Underneath, a connecting portion 3 of a second width extends, a bottom portion 4 of a third width being located at the bottom side. The connecting portion 3 is widthwise located halfway between the head portion 1 and the bottom portion 4. In the head portion a longitudinal slit 5 has been provided comprising side walls 7, each of which are inclined under a small angle, for example 5°, to provide a trapezium shaped profile and a bottom or lowermost surface 6, which is preferably located on the same level as the bottom surface 2 of the head portion.

Below the connecting part 3 there is the bottom portion 4 having a flat surface at the upper side. The bottom side of said portion accommodates a connecting bar 8, which is connected to a number of gliders by means of an intermediate part 9, which can be torn off at its upper side. Such a group of, for example, ten gliders makes the insertion of the gliders in the rail easier.

Figure 2:
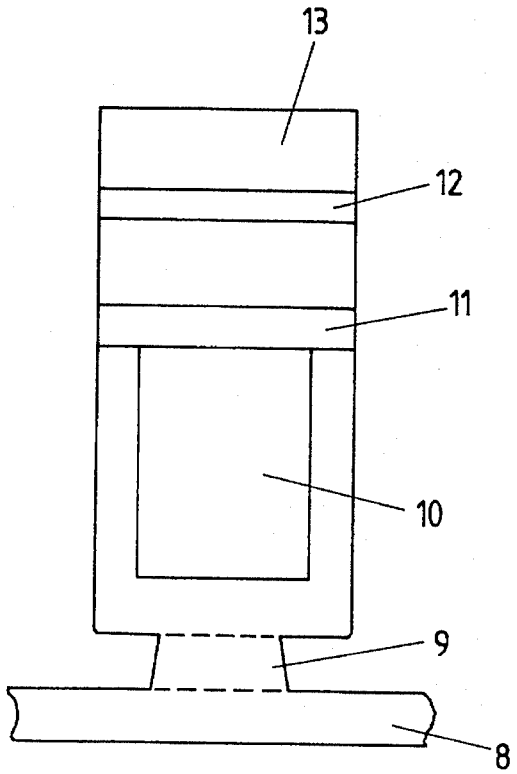
FIG. 2 shows an elevational view of said glider.

As can be seen especially in FIG. 2, the glider is provided with an eye 10 located directly below the front wall 11 of the glider's bottom portion 4 and widthwise to one side of the bottom portion 4. It will be appreciated that a first or outside wall of the eye 10 is located in a surface 14 that on that side is aligned with the adjoining end of the width of the bottom portion 4, and that a second wall of the eye 10 is located in a curved surface 15 that has been bent from a point parallel to the first wall to the middle 16 of the width of the glider.

Seen in elevational view, the head portion first has a vertical surface 12 and then an almost circularly or cylindrically curved surface 13. This shape has been found to facilitate the insertion with a click of the glider in a rail.

Figure 3:
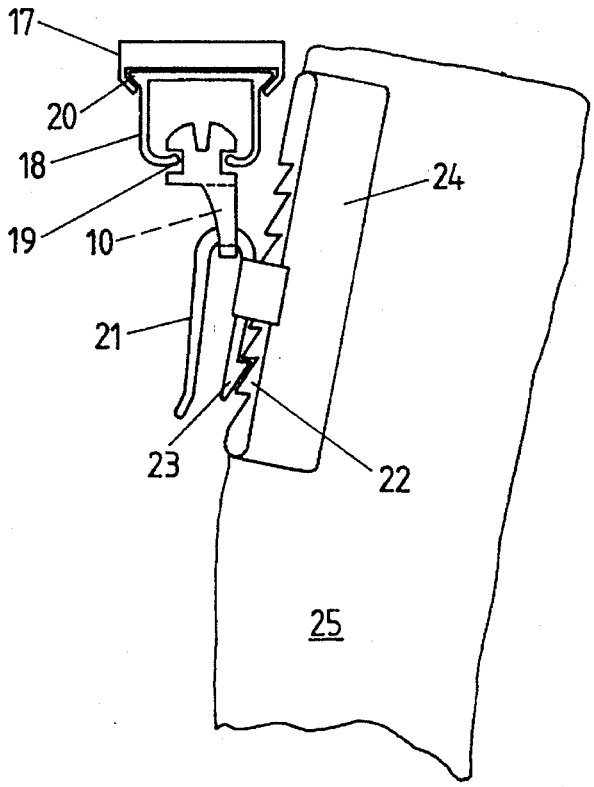
FIG. 3 schematically shows a side-view of a hanging curtain in applying gliders according to the invention.

In FIG. 3 a rail 18 defining a width direction of the glider has been secured by means of a ceiling support 17, which rail has at its bottom side a slot 19, through which a glider according to the invention is introduced.

The upper corners of the rail have reinforcement ribs 20 projecting in horizontal direction, which offer a good grip on the ceiling support 17. In the eye 10 of the glider a curtain-hanging hook 21 is inserted, which, in a manner known per se, by means of a gear rack 22 and a tooth 23 resiliently connected to the hook, is vertically adjustable on a plate 24 to be sewed onto the curtain 25. Such plates are made of a synthetic material which enables the curtain to be fastened by sewing through the curtain and the synthetic material, thus attaching the curtain schematically indicated by 25.

In general, it is appreciated that a curtain extends to the close vicinity of the ceiling. When this is the case, known gliders present the difficulty that the curtain may touch the curtain rail 18 or the ceiling support 17. In applying the invention said disadvantage is avoided.

I claim:

1. Glider for hanging a curtain (25) on a longitudinal curtain rail (18) which defines a width direction for the glider, comprising:

a head portion (1) having a bottom surface (2) with a first width, below the head portion a connecting portion (3) with a second width smaller than the first width, underneath the connecting portion a bottom portion (4) with a third width greater than the second width of the connecting portion, but not exceeding the first width of the head portion, a slit provided in the middle of the head portion which has a trapezium-shaped profile and which has a lowermost surface, the lowermost surface being parallel to the bottom surface of the head portion and substantially aligned with the bottom surface of the head portion corresponding with the rail, wherein the connecting portion is located in the width direction centrally of the head portion and the bottom portion so that the glider is longitudinally and symmetrically in the width direction received on the rail with bottom surface (2) engaging the rail, and the bottom portion being provided with an eye (10) forming a closed loop, in which a curtain hook attached to a curtain can be inserted, characterized in that the eye, in the width direction, is located on one side of the third width of the bottom portion.

2. Glider as claimed in claim 1, characterized in that a first wall of the eye is located in a surface that on that side is aligned with the adjoining end of the bottom portion's width.

3. Glider as claimed in claim 1, characterized in that a second wall of the eye is located in a curved surface (15) that has been bent from a point parallel to the first wall (14) to the middle (16) of the glider's width.

4. Glider for hanging a curtain (25) on a longitudinal curtain rail (18) which defines a width direction for the glider, comprising:

a head portion (1) having a bottom surface (2) with a first width, below the head portion a connecting portion (3) with a second width smaller than the first width, underneath the connecting portion a bottom portion (4) with a third width greater than the second width, wherein the connecting portion is located in the width direction centrally of the head portion and the bottom portion so that the glider is longitudinally and symmetrically in the width direction received on the rail with bottom surface (2) engaging the rail, the bottom portion being provided with an eye (10), in which a curtain hook attached to a curtain can be inserted, the eye, in the width direction, being located on one side of the third width of the bottom portion, and a slit (5) in the middle of the head portion (1) having a lowermost surface which is substantially aligned with the bottom surface (2) of the head portion corresponding with the rail.

5. Glider as claimed in claim 4, characterized in that a first wall of the eye is located in a surface that on that side is aligned with the adjoining end of the bottom portion's width.

6. Glider as claimed in claim 4, characterized in that a second wall of the eye is located in a curved surface that has been bent from a point parallel to the first wall to the middle of the glider's width.

7. Glider as claimed in claim 4, characterized in that the glider is made of rigid elastic synthetic material.

8. Glider as claimed in claim 7, characterized in that the slit has a trapezium-shaped profile and the lowermost surface is parallel to the bottom surface of the head portion.

* * * * *